United States Patent [19]

Villeval

[11] Patent Number: 4,494,669

[45] Date of Patent: Jan. 22, 1985

[54] STOPPER FOR A HEAT EXCHANGER CIRCUIT

[75] Inventor: Denis Villeval, Maurepas, France

[73] Assignee: Valeo, Paris, France

[21] Appl. No.: 447,683

[22] Filed: Dec. 7, 1982

[30] Foreign Application Priority Data

Dec. 14, 1981 [FR] France ..... 81 23316

[51] Int. Cl.[3] ..... B65D 51/16

[52] U.S. Cl. ..... 220/204; 220/366; 220/293

[58] Field of Search ..... 220/204, 203, 366, 293, 220/DIG. 32, DIG. 33

[56] References Cited

U.S. PATENT DOCUMENTS

| | | | |
|---|---|---|---|
| 1,973,258 | 9/1934 | Jensen | 220/203 |
| 2,484,083 | 10/1949 | Findley | 220/203 |
| 3,047,235 | 7/1962 | Eshbaugh et al. | 220/203 X |
| 3,386,611 | 6/1968 | Crute . | |
| 3,715,049 | 2/1973 | McMullen et al. | 220/203 |
| 3,820,680 | 6/1974 | Friend | 220/203 |
| 4,136,795 | 1/1979 | Crute et al. | 220/203 |
| 4,185,751 | 1/1980 | Moore et al. | 220/203 |
| 4,241,845 | 12/1980 | Daly et al. | 220/203 |

FOREIGN PATENT DOCUMENTS

| | | |
|---|---|---|
| 854159 | 8/1952 | Fed. Rep. of Germany . |
| 847514 | 10/1939 | France . |
| 2361275 | 3/1978 | France . |

*Primary Examiner*—Stephen Marcus
*Assistant Examiner*—Robert Petrik
*Attorney, Agent, or Firm*—Dennison, Meserole, Pollack & Scheiner

[57] ABSTRACT

A stopper (11) is disclosed for fixing to the end of an inlet tube (10) to a heat exchanger circuit such as a radiator for an internal combustion engine or an associated expansion chamber. The stopper comprises a body (12) housing a set of rated overpressure and underpressure valves (27 to 33) and a cylindrical skirt (15) having bayonet-fixing means (20) for fixing to the end of the inlet tube. The set of valves is mounted on a plate (21) located inside the stopper housing and so arranged as to enable direct communication independently of the set of valves between the inside and the outside of the heat exchanger circuit when the stopper is in an intermediate position between its position for fully closing the inlet tube and its open position, the communication being prevented when the stopper is in the fully closed position.

9 Claims, 4 Drawing Figures

STOPPER FOR A HEAT EXCHANGER CIRCUIT

The present invention relates to a stopper for a heat exchanger circuit, and in particular for a radiator or an expansion chamber forming part of a cooling circuit for an internal combustion engine. More particularly, the invention relates to a bayonet-fixing type of stopper.

BACKGROUND OF THE INVENTION

It is known that such stoppers are generally provided with a set of rated overpressure and underpressure valves which serve, when the stopper is mounted on a radiator, to maintain the pressure inside the radiator between specified maximum and minimum values. The maximum pressure, for which the stopper is rated is higher than atmospheric pressure. On some occasions when the stopper is removed, this can lead to a jet of steam escaping through the resulting orifice, and hence to a risk of scalding.

This drawback is avoidable when the radiator stopper is of the screw on type for fixing over the end of an inlet tube to the radiator. This is because unscrewing the stopper over a complete turn is a progressive operation in which a passage gradually opens up in between the inside surface of the stopper and the outside surface of the inlet tube, whereby the excess steam pressure inside the radiator is released before the stopper is completely unscrewed. Also, channels can be formed in the skirt or threaded rim of the stopper to direct or guide the escaping steam in a particular direction, generally downwards, to further reduce the risk of scalding.

In known bayonet-fixing type stoppers which provide for steam to escape progressively while the stopper is being undone, the valves in the stopper bear against a seating on the water box from which the inlet tube projects. Manufacturing tolerances for water boxes, and the deformation to which they are subject in operation, make it impossible to rate the valves to accurate and reproducible settings, which can lead to the radiator functioning badly. Further, during stopper opening the steam escapes progressively via the overpressure valve and thus depends on the state thereof.

Preferred embodiments of the invention provide a bayonet-fixing stopper, in particular for the radiator of an internal combustion engine, which avoids the above drawbacks.

Further, in said preferred embodiments, the structure is simple and easy to assemble, and the cost is much the same as prior art bayonet-fixing stoppers.

SUMMARY OF THE INVENTION

The present invention provides a stopper for fixing to the end of a inlet tube to a heat exchanger circuit such as a radiator for an internal combustion engine or an associated expansion chamber, the stopper comprising a body housing, a set of rated overpressure and underpressure valves and a cylindrical skirt having bayonet-fixing means for fixing to said end of the inlet tube, wherein said set of valves is mounted on a plate located inside said stopper housing and so arranged as to enable direct communication independently of the set of valves between the inside and the outside of the heat exchanger circuit when the stopper is in an intermediate position between its position for fully closing the inlet tube and its open position, said communication being prevented when the stopper is in the fully closed position.

Thus in accordance with the invention, direct communication can be established between the outside of the heat exchanger circuit and the inside in a manner which is unaffected by the state of the valves. This takes place while the stopper is opening, but before it is fully opened. The intermediate position is preferably arranged to hold the stopper on the inlet tube even in the vent of a violent expulsion of gas to the outside.

Said plate may also serve as a seat for the overpressure valve, with said direct communication in the intermediate position taking place in parallel with the set of valves via a gap between the end of the inlet tube and said plate and said skirt, said direct communication being closed when the stopper is in the fully closed position by said plate being pressed in a sealed manner to said end of the inlet tube.

In one embodiment of the invention said plate is fixedly mounted inside said stopper and moves away from the end of the inlet tube as the stopper moves from its fully closed position to the intermediate position.

In another embodiment of the invention, said plate is axially movable inside said stopper between two end positions defined by end stops inside the stopper, and the distance between said end positions is less than the axial displacement of the stopper between its fully closed position and the intermediate position.

BRIEF DESCRIPTION OF THE DRAWINGS

An embodiment of the invention is described by way of example with reference to the accompanying drawings, in which.

MORE DETAILED DESCRIPTION

Figure 1:
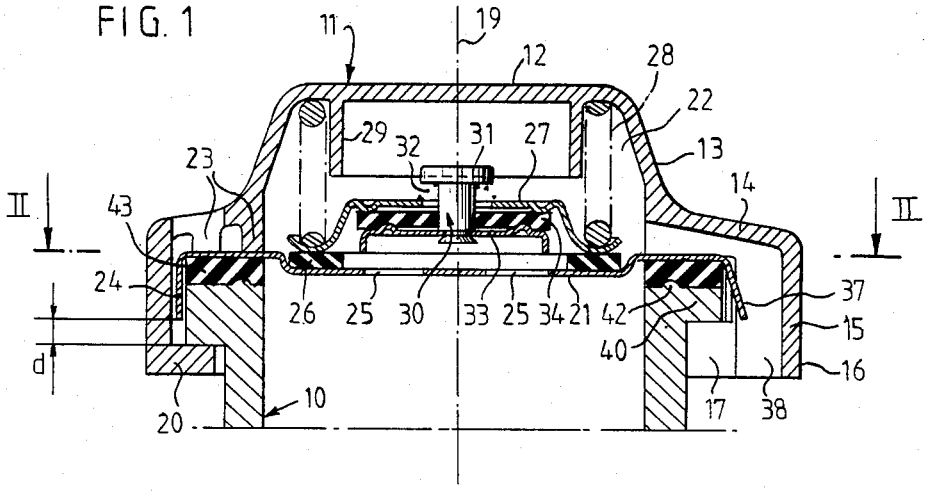
FIG. 1 is a schematic section through a stopper in accordance with the invention fixed to a tube, the section being along a line I—I of FIG. 2.
Figure 2:
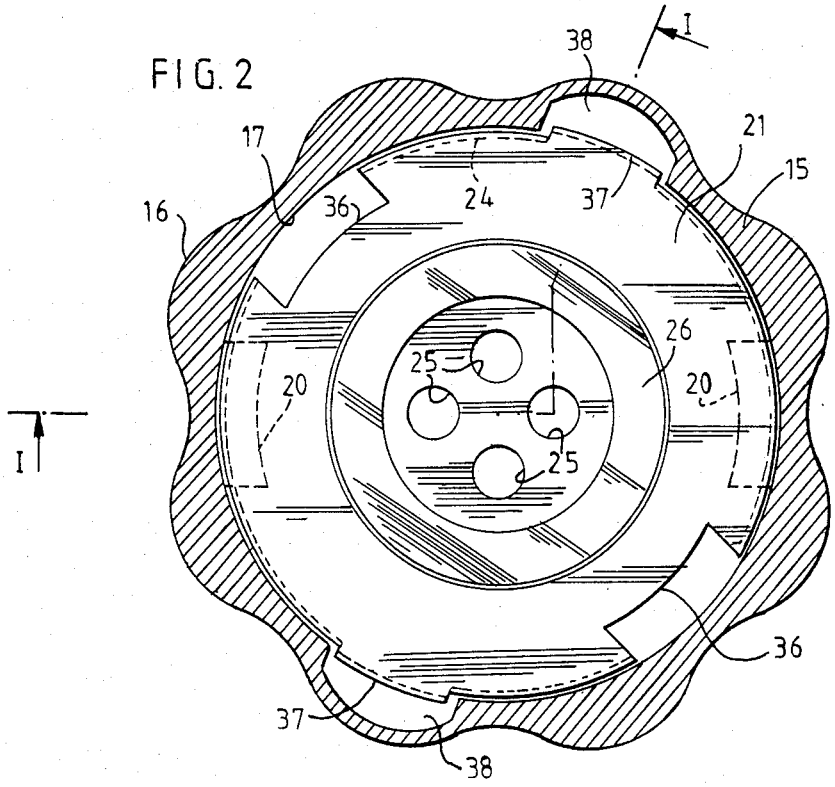
FIG. 2 is a section through the stopper along a line II—II of FIG. 1.

The stopper shown in the drawings is a stopper for the radiator of a motor vehicle, and it is intended to close the filler inlet of the radiator in a sealed manner. The inlet is in the form of a short length of tube 10 which extends substantially vertically from the top of one of the radiator's water boxes.

A stopper in accordance with the invention can also be used to close a filler inlet to an expansion chamber.

The stopper 11 in accordance with the invention comprises a circular base 12 connected by a flaring truncated cone portion 13 to an annular rim 14 from which there projects a generally cylindrical skirt 15. The outside surface 16 of the skirt is fluted for grasping in the hand, while its inside surface 17 is cylindrical about an axis 19. The lower edge of the skirt 15 has two diametrically opposed transverse lugs 20 which extend radially towards each other.

A set of overpressure and underpressure valves is housed inside the stopper 11. It is mounted on a substantially circular plate 21 which extends across the inside of the stopper to delimit a chamber 22 inside the stopper for housing the valves.

In the embodiment shown, the plate 21 is axially movable between an upper position fixed by stops 23 which project down from the underside of the annular rim 14, and a lower position fixed by the skirt's transverse lugs 20. The periphery of the plate 21 has a substantially cylindrical rims 24 extending downwards from the plate and suitable for bearing against the lugs 20 on the skirt 15.

The central portion of the plate 21 has holes 25 and its upper surface is fitted with a washer 26 of rubber or elastomer which surrounds the holes 25 and on which there presses the rim of an upsidedown dish-shaped plate 27 which has a hole through its center. A helical spring 28 is fitted around a tubular sleeve 29 on the inside surface of the base 12 and thrusts the dish-shaped plate 27 down against the washer 26 on the plate 21. The plate 21 is thus likewise under constant thrust from the spring 28 urging it towards its lower position as defined by its rim 24 pressing against the lugs 20 on the skirt 15. The overpressure valve is constituted by the dish-shaped plate 27 being lifted off the plate 21 against the force of the spring 28.

The underpressure valve is built around a cylindrical rod 30 which is a loose fit through the central orifice of the dish-shaped plate 27. The rod has a head 31 at its top end and its bottom end is fixed to a disk 33 which fits inside the dish-shaped plate 27. A spring 32 acts between the top surface of the plate 27 and the bottom surface of the head 31, and a rubber or elastomer washer 34 is sealed to the rod 30 and rests on the disk 33 in such a manner that the spring 32 causes the washer 34 to be squeezed between the disk 33 and the dish-shaped plate 27. Advantageously, both the disk 33 and the plate 27 have circular ridges projecting towards the washer 34 to improve sealing of the underpressure valve.

The substantially circular plate 21 has two diametrically opposed cut-outs 36 in its periphery which are shaped to accommodate the lugs 20, and the diameter of the cylindrical rim 24 projecting from the plate 21 is slightly less than the diameter of the inside wall 17 of the stopper's skirt 15. Thus, the plate 21 can be assembled inside the stopper by placing it under the skirt thereof in such a position as to align the cut-outs 36 with the lugs 20. The plate 21 is then moved bodily along the axis 19 until it has moved inside the stopper beyond the lugs 20. It is then rotated about the axis 19 through about 30°, thereby preventing it from coming out again by virtue of the rim 24 resting against the lugs 20.

The plate 21 may be prevented from subsequent rotation inside the body of the stopper and about its axis 19 as follows: the rim 24 is cut to form two diametrically opposed tabs 37 which are folded outwardly at a slight angle away from the rest of the cylindrical rim 24. The tabs 37 then enter cavities 38 made in the inside surface of the skirt 15 where it departs from being perfectly cylindrical. The cavities 38 constitute channels for providing permanent communication between the chamber 22 and the outside of the stopper.

When the plate 21 is moved into the stopper, the sloping tabs 37 press resiliently against the cylindrical inside surface 17 of the skirt 15. The plate 21 is then turned through a sufficient angle about the axis 19 to bring the tabs 37 level with the cavities 38, into which they spring by virtue of their resilience. Once the tabs are engaged in the cavities, the plate 21 is substantially prevented from rotating about the axis 19.

Figure 3:
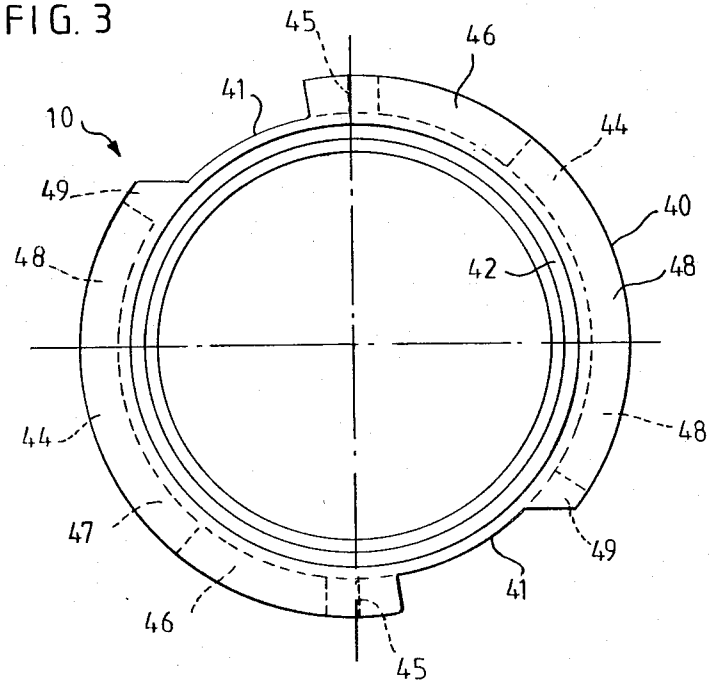
FIG. 3 is an end view of the tube shown in FIG. 1.

The inlet tube 10 on which the stopper 11 is mounted comprises a conventional annular flange 40 (see FIGS. 3 and 4), which is interrupted by two diametrically opposed notches 41 through which the stopper's lugs 20 pass.

The top surface of the flange 40 is substantially plane, and has an axially extending circular rib 42 which cooperates with a sealing ring 43 mounted on the lower face of the circular valve plate 21, just inside its rim 24 (see FIG. 1).

Figure 4:
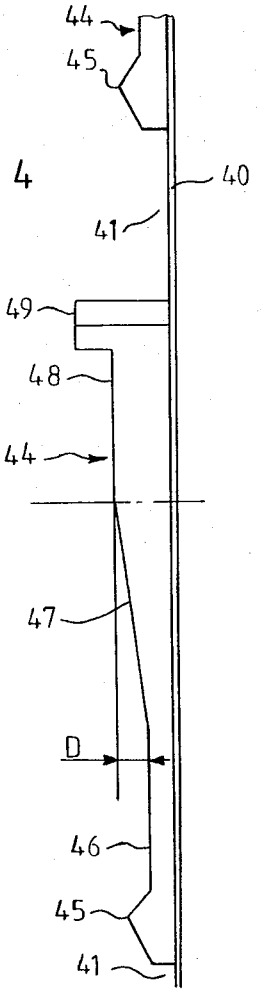
FIG. 4 is a diagrammatic development of the lower edge of a rim on the tube.

The bottom surface of the flange 40 is shaped to cooperate with the lugs 20 on the stopper's skirt 15, and comprises two diametrically opposed inclined ramps 44 one of which is shown for the sake of clarity in profile in the developed view of FIG. 4.

Starting from the associated notch 41, each of the inclined ramps 44 comprises a triangular safety tooth 45 pointing downwards, a first horizontal portion 46, a sloping ramp 47, and then a second horizontal portion 48 terminated by a stop 49.

The stopper works as follows:

When the inlet tube 10 is closed as shown in FIG. 1, the lugs 20 on the skirt 15 are engaged under the second flat portions 48 of the inclined ramps 44 formed underneath the flange 40. In this position, the inwardly projecting stops 23 in the stopper 11 are pressed against the valve plate 21 near to its periphery, thereby pressing the plate 21 against the sealing ring 43 and thus sealing the stopper to the flange 40 on the inlet tube.

So long as the pressure inside the radiator remains within the limits set by the overpressure and the underpressure valves, the stopper stays in the position shown in FIG. 1, ie. the periphery of the dish-shaped plate 27 is pressed in a sealed manner by the spring 28 against the sealing washer 26 mounted on the plate 21, and the disk 33 presses the sealing washer 34 in a sealed manner against the dish-shaped plate 27 by virtue of the action of the spring 32 urging the head 31 away from the plate 27. Under these conditions there is no communication between the upper inside space 22 of the stopper and the inside volume of the inlet tube.

If the pressure inside the radiator increases, it applies an increasing upwards force on the movable assembly of parts 27 to 33. Once said force exceeds the force of the spring 28 on the plate 27, the said assembly lifts away from the washer 26. Communication is thereby established between the inside of the radiator and the outside of the stopper via the holes 25 through the plate 21, the gap created between the edge of the plate 27 and the washer 26, the stopper's inside space 22 and the cavities 38. The excess pressure can thus escape freely to the outside until the force exerted on the assembly 27 to 33 drops below the force exerted thereon by the spring 28.

If the pressure inside the radiator is less than the atmospheric pressure outside, a downwards force is exerted on the washer 34 and tends to move it downwards together with the disk 33 and the rod 30. When the force acting on the washer 34 is greater than the force applied by the spring 32, the washer 34 actually moves downwards taking the disk 33 and the rod 30 with it, thereby moving away from the plate 27. Communication is thus established between the inside of the radiator and the inside space 22 in the stopper which is itself in communication with the atmosphere. The path goes via the central hole in the plate 27, the gap left between the washer 34 and the plate 27, and the holes 25 in the plate 21.

When the stopper 11 is to be removed from the radiator, it should be turned about one fourth of a turn in the appropriate direction starting from the closed position shown in FIG. 1. While turning, the lugs 20 on the skirt 15 move from the second horizontal portion 48 of the flange 40 on the inlet tube along the sloping ramp 47 to the first horizontal portion 46, thereby causing the stopper to move axially a distance D which is equal to the distance between the second and first horizontal portions 48 and 46. As the stopper moves from its closed position to the intermediate position in which the lugs 20 are resting against the first plane portion 46, the plate 21 continues to be urged constantly by the spring 28 and so moves progressively away from the stops 23 and remains applied in a sealed manner against the flat sealing ring 43 on the flange 40 of the inlet tube 10. So long as it remains applied against the sealing ring 43, no communication is established between the inside of the radiator and the outside, (and provided that the pressure inside the radiator remains in the range determined by the overpressure and underpressure valves).

However, by ensuring that the distance D is greater than the distance d between the lower edge of the rim 24 of the plate 21 and the lugs 20 of the stopper while the plate 21 is urged against the stops 23, the rim 24 abuts against the lugs 20 before the lugs reach the first horizontal portion 46. Thus by the time they reach the first horizontal portion 46, the lugs 20 have lifted the plate 21 together with the sealing ring 43 off the flange 40 at the end of the inlet tube 10. The resulting gap between the sealing ring 43 and the flange 40 establishes direct communication between the inside of the radiator and the outside via the cavities 38. The pressure inside the radiator thus becomes equal to the pressure outside while the stopper 11 is still held on the inlet tube 10 by the lugs 20 which are engaged on the first horizontal portion 46 of the inclined ramps. The spring 28 keeps them actively pressed in place.

The stopper is finally removed by passing the lugs 20 over the safety teeth 45, which requires the spring 28 to be recompressed, which may re-seal the sealing ring 43 for an instant.

In a variant, not shown in the figures, the plate 21 is fixedly mounted inside the stopper 11, eg. by snap fitting means. As the stopper is turned, there is no spring force to ensure that the lugs 20 follow the ramp 47; however, if the pressure inside the radiator is greater than atmospheric, the pressure urges the stopper upwardly and in due course is released as a gap appears round the sealing ring 43. Once the lugs have reached the intermediate position the pressure will probably have had time to dissipate, and the stopper may well be re-sealed by the user's hand pushing it down. In such a case the safety tooth serves little purpose, but it is advisable to retain it, just to ensure that the pressure does indeed have time to dissipate before the stopper can be finally removed, eg. by the drop in pressure causing the liquid in the radiator to start boiling.

I claim:

1. A stopper adapted to be fixed to the end of an inlet tube to a heat exchanger circuit for an internal combustion engine, the stopper comprising a body having a top portion, a cylindrical skirt provided with bayonet-fixing means adapted for fixing the stopper to the end of the inlet tube, a plate located within said body which is axially movable between two end positions, end stops on said stopper which define the end positions, and a set of rated overpressure and underpressure valves housed in said stopper body between the top portion and said plate, wherein said plate is in one of said end positions and is spaced apart from the end of the inlet tube when the stopper is in an intermediate position between its position for fully closing the inlet tube and its position for opening the inlet tube, thus forming a gap between the end of the inlet tube and said plate, which gap provides communication between the outside and the inside of the exchanger circuit, and wherein said plate is in the other of said end positions and is pressed in a sealed manner to the end of the inlet tube when the stopper is in the fully closed position, thus preventing communication between thef outside and inside of the exchanger circuit, other than through the overpressure or underpressure valve.

2. A stopper according to claim 1, wherein the end stops for one of the end positions are constituted by transverse lugs projecting from the skirt of the stopper.

3. A stopper according to claim 1, wherein said plate is constantly urged by a spring towards the end position which it occupies when the stopper is in the open position.

4. A stopper according to claim 3, wherein said plate forms a seat for the overpressure valve and said spring is a spring associated with the overpressure valve.

5. A stopper according to claim 1, wherein there are transverse lugs projecting inwardly from the skirt of the stopper, and wherein said plate is circular or annular and has cut-outs in its periphery to enable the plate to be assembled inside the stopper body by moving the plate past said transverse lugs.

6. A stopper according to claim 5, wherein said plate is mounted inside said stopper body by being moved along the longitudinal axis of the stopper past said lugs, then by being rotated about said axis, and then by being held fast against any subsequent rotation.

7. A stopper according to claim 6, wherein the plate includes means for preventing subsequent rotation, said means comprising resiliently deformable tabs projecting outwardly from said plate and suitable for engaging cavities in the inside surface of the stopper when the plate has been rotated to a predetermined position about said axis.

8. A stopper according to claim 5 wherein said plate has a cylindrical rim around its periphery.

9. A stopper according to claim 1, wherein the plate is free to move axially over a distance d between its end positions, and wherein the stopper moves an axial distance D between its fully closed position and its intermediate position, said distance D being greater than said distance d.

* * * * *